US007485605B2

(12) United States Patent
Nalesnik

(10) Patent No.: US 7,485,605 B2
(45) Date of Patent: Feb. 3, 2009

(54) LUBRICANT AND FUEL COMPOSITIONS CONTAINING 2-(S(N)-MERCAPTOBENZOTHIAZOLE) SUCCINIC AND METHYLENE SUCCINATE ESTERS

(75) Inventor: Theodore E. Nalesnik, Hopewell Junction, NY (US)

(73) Assignee: Crompton Corporation, Middlebury, CT (US)

( * ) Notice: Subject to any disclaimer, the term of this patent is extended or adjusted under 35 U.S.C. 154(b) by 368 days.

(21) Appl. No.: 11/024,218

(22) Filed: Dec. 27, 2004

(65) Prior Publication Data

US 2006/0089271 A1 Apr. 27, 2006

Related U.S. Application Data

(60) Provisional application No. 60/621,671, filed on Oct. 26, 2004.

(51) Int. Cl.
*C10M 135/36* (2006.01)
*C10M 137/10* (2006.01)

(52) U.S. Cl. ..... 508/275; 508/371

(58) Field of Classification Search ..... 508/275, 508/371

See application file for complete search history.

(56) References Cited

U.S. PATENT DOCUMENTS

| | | | | |
|---|---|---|---|---|
| 2,725,382 | A * | 11/1955 | Harman | 548/170 |
| 2,985,590 | A | 5/1961 | Morway et al. | |
| 3,293,181 | A | 12/1966 | Stuart | 252/32.7 |
| 3,396,109 | A | 8/1968 | Butler et al. | 252/32.7 |
| 3,397,145 | A | 8/1968 | Cyba | 252/32.7 |
| 3,442,804 | A | 5/1969 | LeSuer | 252/32.7 |
| 3,637,499 | A | 1/1972 | Pollak | 252/32.7 |
| 4,696,763 | A * | 9/1987 | Bentley et al. | 252/391 |
| 4,917,809 | A * | 4/1990 | Zinke et al. | 508/271 |
| 5,069,805 | A * | 12/1991 | Braig et al. | 508/276 |
| 5,084,195 | A | 1/1992 | Camenzind et al. | 252/47.5 |
| 5,300,243 | A | 4/1994 | Camenzind et al. | 252/47.5 |
| 5,498,809 | A * | 3/1996 | Emert et al. | 585/13 |
| 5,512,190 | A | 4/1996 | Anderson et al. | 252/47 |
| 5,514,189 | A | 5/1996 | Farng et al. | 44/383 |
| 6,271,185 | B1 * | 8/2001 | Kodali et al. | 508/487 |

FOREIGN PATENT DOCUMENTS

| | | | |
|---|---|---|---|
| JP | 1995268369 | A | 10/1995 |

* cited by examiner

*Primary Examiner*—Glenn Caldarola
*Assistant Examiner*—Jim Goloboy
(74) *Attorney, Agent, or Firm*—Jaimes Sher

(57) ABSTRACT

Disclosed herein is composition comprising:

(A) a lubricant or a hydrocarbon fuel;

(B) at least one additive that is a 2-(S(N)-mercaptobenzothiazole)succinic or methylene succinate esters of a structure defined herein; and optionally (C) at least one zinc dihydrocarbyldithiophosphate.

19 Claims, No Drawings

LUBRICANT AND FUEL COMPOSITIONS CONTAINING 2-(S(N)-MERCAPTOBENZOTHIAZOLE) SUCCINIC AND METHYLENE SUCCINATE ESTERS

I claim the benefit under Title 35, United States Code, § 119 to U.S. Provisional Application No. 60/621,671, filed Oct. 26, 2004, entitled LUBRICANT AND FUEL COMPOSITIONS CONTAINING 2-(S(N)-MERCAPTOBENZOTHIAZOLE) SUCCINIC AND METHYLENE SUCCINATE ESTERS.

BACKGROUND OF THE INVENTION

1. Field of the Invention

This invention is related to fuels, especially hydrocarbon fuels, and lubricants, especially lubricating oils, and, more particularly, to a fuel or lubricant composition containing a class of anti-wear, anti-fatigue, and extreme pressure additives that are derived from 2-(S&N-mercaptobenzothiazole) succinic and methylene succinate esters. "S&N" refers to the sulfur and nitrogen bonding of the mercaptobenzothiazole to the maleate addition product. Alternatively, the nomenclature S(N)-mercaptobenzothiazole can be employed.

2. Description of Related Art

In developing lubricating oils, there have been many attempts to provide additives that impart anti-fatigue, anti-wear, and extreme pressure properties thereto. Zinc dihydrocarbyldithiophosphates (ZDDP) have been used in formulated oils as anti-wear additives for more than 50 years. However, zinc dihydrocarbyldithiophosphates give rise to ash, which contributes to particulate matter in automotive exhaust emissions, and regulatory agencies are seeking to reduce emissions of zinc into the environment. In addition, phosphorus, also a component of ZDDP, is suspected of limiting the service life of the catalytic converters that are used on cars to reduce pollution. It is important to limit the particulate matter and pollution formed during engine use for toxicological and environmental reasons, but it is also important to maintain undiminished the anti-wear properties of the lubricating oil.

In view of the aforementioned shortcomings of the known zinc and phosphorus-containing additives, efforts have been made to provide lubricating oil additives that contain neither zinc nor phosphorus or, at least, contain them in substantially reduced amounts. Illustrative of non-zinc, i.e., ashless, non-phosphorus-containing lubricating oil additives are the reaction products of 2,5-dimercapto-1,3,4-thiadiazoles and unsaturated mono-, di-, and tri-glycerides disclosed in U.S. Pat. No. 5,512,190 and the dialkyl dithiocarbamate-derived organic ethers of U.S. Pat. No. 5,514,189.

U.S. Pat. No. 5,512,190 discloses an additive that provides anti-wear properties to a lubricating oil. The additive is the reaction product of 2,5-dimercapto-1,3,4-thiadiazole and a mixture of unsaturated mono-, di-, and triglycerides. Also disclosed is a lubricating oil additive with anti-wear properties produced by reacting a mixture of unsaturated mono-, di-, and triglycerides with diethanolamine to provide an intermediate reaction product and reacting the intermediate reaction product with 2,5-dimercapto-1,3,4 thiadiazole.

U.S. Pat. No. 5,514,189 discloses that dialkyl dithiocarbamate-derived organic ethers have been found to be effective anti-wear/antioxidant additives for lubricants and fuels.

U.S. Pat. No. 3,293,181 discloses that zinc dialkyl dithiophosphates of improved thermal stability can be provided by the zinc salts of mixed dialkyl dithiophosphoric acids in which the alkyl groups are derived from a mixture of at least two different branched chain primary alcohols, one of the alcohols being isobutyl alcohol and the other containing at least six carbon atoms.

U.S. Pat. No. 3,396,109 discloses the preparation of phosphorus- and nitrogen-containing compositions by reacting a metal salt of a phosphinodithioic acid, especially a zinc salt of a diarylphosphinodithioic acid, with an amine, especially an aliphatic amine having from one to about forty carbon atoms. The compositions are said to be useful as additives for lubricating oils and automatic transmission fluids, in which they act as oxidation inhibitors and anti-wear agents. They are also said to afford synergistic oxidation inhibition properties when used with phenyl β-naphthyl amines.

U.S. Pat. No. 3,397,145 discloses an alkylthiophosphoric acid salt formed by the addition reaction thereof to a tertiary nitrogen atom of a condensation product containing said tertiary atom and comprising a polymeric reaction product.

U.S. Pat. No. 3,442,804 discloses a lubricating composition containing a small amount of a particularly defined zinc phosphorodithioate. The zinc phosphorodithioate is illustrated by that derived from dihydrocarbon phosphorodithioic acid in which the hydrocarbon radicals are primary alkyl radicals and consist of a mixture of lower molecular weight radicals (i.e., having less than 5 carbon atoms) and higher molecular weight radicals (i.e., having at least 5 carbon atoms). In the particularly defined zinc phosphorodithioate, the ratio of the lower molecular weight radicals to the higher molecular weight radicals, expressed on a molar basis, is with the range of 1:1 to 3:1.

U.S. Pat. No. 3,637,499 discloses lubricating oil compositions containing as anti-wear and detergent-inhibitor additives therein, an amine neutralized derivative of a dithiophosphoric acid prepared by reacting a long chain alkenyl-substituted $C_3$-$C_8$ monocarboxylic acid of 400-3,000 molecular weight with a primary or secondary hydrocarbylol amine, reacting the resultant amide with a phosphorus sulfide and neutralizing the resultant dithiophosphoric acid with a polyamino compound.

U.S. Pat. No. 4,696,763 discloses anticorrosive compositions that comprise: (A) an applicational medium selected from (a) surface coatings and (b) wholly or partly aqueous non-coating media, (B) as corrosion inhibitor, an effective corrosion-inhibiting amount of at least one aliphatic or cycloaliphatic mono-, di-, tri- or tetra-carboxylic acid ester or anhydride which is substituted in the aliphatic or cycloaliphatic residue by one or more groups having the formula

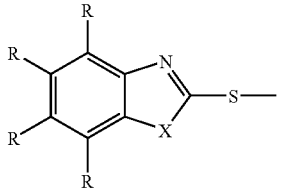

in which X is oxygen, sulphur or NH; and each R, independently, is hydrogen, alkyl, haloalkyl, alkoxy, alkylthio, alkylsulphonyl, cycloalkyl, phenyl, alkylphenyl, phenylalkyl, halogen, cyano, nitro, hydroxy, —COOH, —COOalkyl or a primary-, secondary- or tertiary amino- or carbamoyl group; or a non-toxic base addition salts of those components (B) which contain free carboxyl group.

U.S. Pat. Nos. 5,084,195 and 5,300,243 disclose N-acyl-thiourethane thioureas as anti-wear additives specified for lubricants or hydraulic fluids.

U.S. Pat. No. 5,498,809 discloses oil soluble copolymers derived from ethylene and 1-butene which have a number average molecular weight between about 1,500 and 7,500, at least about 30 percent of all polymer chains terminated with ethylvinylidene groups, and ethylene-derived content of not greater than about 50 weight percent, and which form solutions in mineral oil free of polymer aggregates, as determined by light scattering measurements. Lubricating oil additives, particularly dispersants, produced by the functionalization and derivatization of these copolymers are said to have enhanced performance (e.g., improved dispersancy and pour point) in lubricating oil compositions, attributable in part to the combination of properties characterizing the copolymers.

Japanese patent application JP1995268369A (Mar. 29, 1994) claims additives consisting of hydroxy polycarboxylic ester compounds., e.g., $(R^1—CO_2)_3C—OH$, where $R^1$ is alkyl group of 1-18 carbons. The lubricating oil compounds contain 0.1-40 wt. % of the hydroxy polycarboxylic ester additives. The additives are said to provide abrasion resistance to pure lubricating oils.

The disclosures of the foregoing references are incorporated herein by reference in their entirety.

SUMMARY OF THE INVENTION

The present invention is directed to a lubricant or fuel composition that comprises an additive that can be used alone or in combination with zinc dihydrocarbyldithiophosphates, in order to reduce the amount of zinc dihydrocarbyldithiophosphates that are currently used without diminishing anti-wear performance. These additives can also be used in combination with other additives typically found in fuels and motor oils, as well as other ashless anti-wear additives. Typical additives include dispersants, detergents, anti-wear agents, extreme pressure agents, rust inhibitors, antioxidants, antifoamants, friction modifiers, Viscosity Index (V.I.) improvers, metal passivators, and pour point depressants.

As employed herein, the term "hydrocarbyl" includes hydrocarbon as well as substantially hydrocarbon groups. "Substantially hydrocarbon" describes groups that contain heteroatom substituents that do not alter the predominantly hydrocarbon nature of the group. Examples of hydrocarbyl groups include the following:

(1) hydrocarbon substituents, i.e., aliphatic (e.g., alkyl or alkenyl), alicyclic (e.g., cycloalkyl, cycloalkenyl) substituents, aromatic substituents, aromatic-, aliphatic-, and alicyclic-substituted aromatic substituents, and the like, as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups which, in the context of this invention, do not alter the predominantly hydrocarbon nature of the substituent; those skilled in the art will be aware of such groups (e.g., halo, hydroxy, mercapto, nitro, nitroso, sulfoxy, etc.); and (3) heteroatom substituents, i.e., substituents that will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, for example, sulfur, oxygen, nitrogen, and such substituents as, e.g., pyridyl, furyl, thienyl, imidazolyl, etc. Preferably, no more than about 2, more preferably no more than one, hetero substituent will be present for every ten carbon atoms in the hydrocarbyl group. More preferably, there will be no such heteroatom substituents in the hydrocarbyl group, i.e., the hydrocarbyl group is purely hydrocarbon.

The compounds employed in the practice of this invention are derivatives of 2-(S(N)-mercaptobenzothiazole)succinic and methylene succinate esters that are useful as non-phosphorus-containing, anti-fatigue, anti-wear, extreme pressure additives for fuels and lubricating oils.

The present invention provides a fuel or lubricating oil composition comprising a fuel or lubricating oil and a functional property-improving amount of at least one derivative of 2-(S(N)-mercaptobenzothiazole)succinic and methylene succinate esters.

It is an object of the present invention to provide a new application for derivatives of 2-(S(N)-mercaptobenzothiazole)succinic and methylene succinate esters useful alone or in combination with zinc dihydrocarbyl dithiophosphate that is an improvement over the prior art. Zinc dihydrocarbyldithiophosphate is a general description that includes the following: zinc dialkyldithiophosphate, zinc diaryldithiophosphate, zinc alkylaryldithiophosphate and combinations thereof. It may be used either alone or in combination with other lubricant additives.

The fuel or lubricant additive compositions of the present invention are especially useful as components in many different lubricating oil compositions. The additive compositions can be included in a variety of oils with lubricating viscosity, including natural and synthetic lubricating oils and mixtures thereof. The additives can be included in crankcase lubricating oils for spark-ignited and compression-ignited internal combustion and with the new EGR (exhaust gas recycled) engines. The compositions can also be used in fuels, gas engine lubricants, turbine lubricants, automatic transmission fluids, gear lubricants, compressor lubricants, metal-working lubricants, hydraulic fluids, and other lubricating oil and grease compositions.

The ashless and non-phosphorus anti-fatigue, anti-wear, and extreme pressure additives of the present invention are of the following structures:

(S)

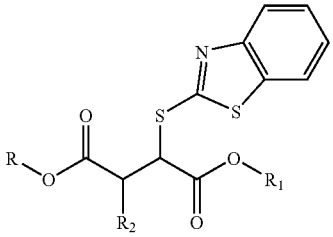

(N)

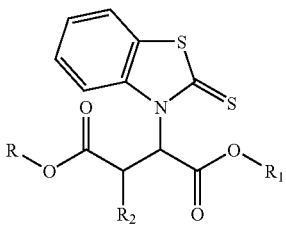

-continued (S)

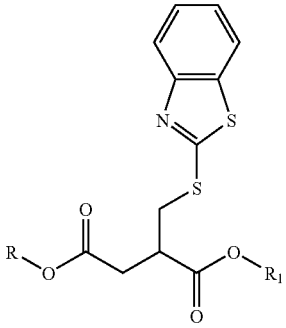

and (N)

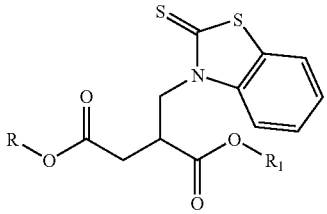

wherein R, $R_1$, and $R_2$ are independently selected from the group consisting of linear and branched alkyl groups. Preferably, such alkyl groups have from 1 to about 12 carbon atoms.

More particularly, the present invention is directed to a composition comprising:

(A) a lubricant or a hydrocarbon fuel;

(B) at least one additive of a structure selected from the group consisting of:

(S)

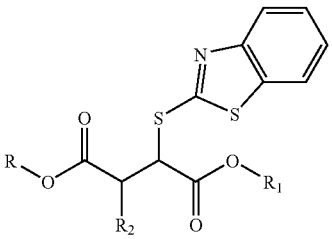

(N)

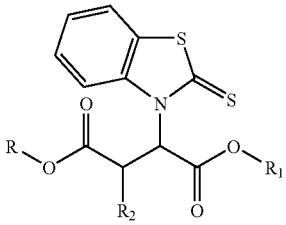

and

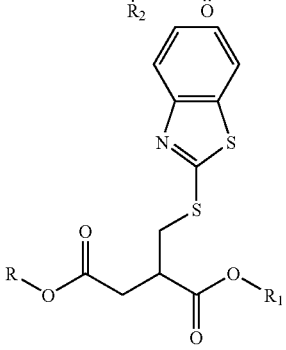

-continued (N)

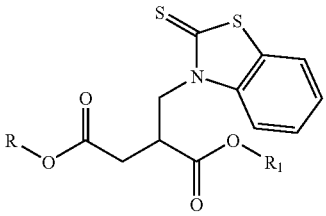

wherein R, $R_1$, and $R_2$ are independently selected from the group consisting of linear and branched alkyl groups; and, optionally, (C) at least one zinc dihydrocarbyldithiophosphate of formula:

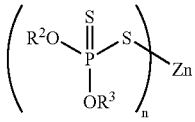

wherein n is 2, and $R^2$ and $R^3$ are independently selected hydrocarbyl groups, preferably alkyl, cycloalkyl, aralkyl, alkaryl, or hydrocarbyl-substituted alkyl, cycloalkyl, aralkyl, or alkaryl groups, and wherein the $R^2$ and $R^3$ groups in the acid each preferably have, on average, at least 3 carbon atoms.

In another embodiment, the present invention is directed to a method for improving the anti-fatigue, anti-wear, and extreme pressure properties of lubricants and hydrocarbon fuels comprising adding to said lubricants and hydrocarbon fuels a functional property-improving amount of:

(A) at least one additive of a structure selected from the group consisting of:

(S)

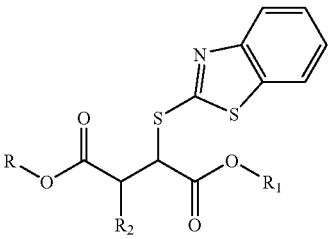

(N)

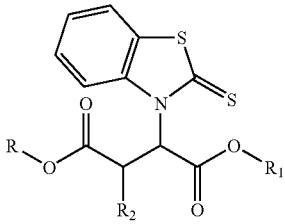

-continued (S)

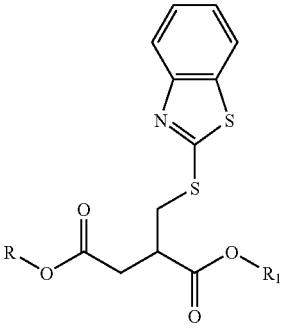

and (N)

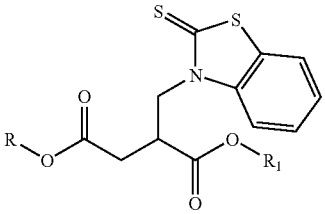

wherein R, $R_1$, and $R_2$ are independently selected from the group consisting of linear and branched alkyl groups; and, optionally, (B) at least one zinc dihydrocarbyldithiophosphate of formula:

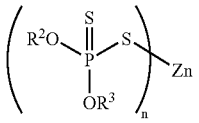

wherein n is 2, and $R^2$ and $R^3$ are independently selected hydrocarbyl groups or hydrocarbyl-substituted alkyl groups.

The derivatives of 2-(S(N)-mercaptobenzothiazole)succinic and methylene succinate esters are present in the compositions of the present invention in a concentration in the range of from about 0.01 to about 10 wt %.

The zinc dihydrocarbyldithiophosphate, when present, is present in the compositions of the present invention in a concentration in the range of from about 0.01 to about 10 wt %.

The combination of derivatives of 2-(S(N)-mercaptobenzothiazole)succinic and methylene succinate esters and zinc dihydrocarbyldithiophosphate are present in the compositions of the present invention in a concentration in the range of from about 0.02 to about 20 wt %.

DESCRIPTION OF THE PREFERRED EMBODIMENTS

As stated above, the ashless and non-phosphorus anti-fatigue, anti-wear, and extreme pressure additives of the present invention are of the following structures:

(S)

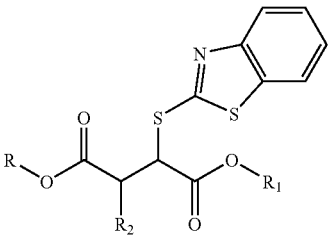

(N)

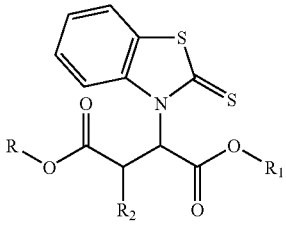

(S)

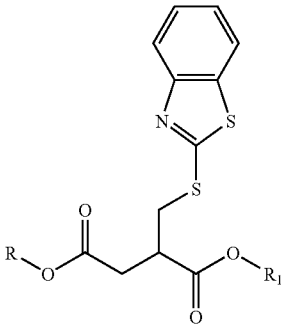

and (N)

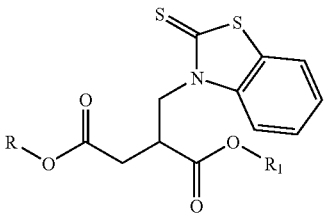

wherein R, $R_1$, and $R_2$ are independently selected from the group consisting of linear and branched alkyl groups. Preferably, such alkyl groups have from 1 to about 12 carbon atoms, e.g., methyl, ethyl, propyl, butyl, pentyl, hexyl, heptyl, octyl, nonyl, decyl, undecyl, dodecyl, isomers of the foregoing, and the like.

The general synthesis and examples of synthesized additives employed herein follows.

General Synthesis of Additives

The mercaptobenzothiazole(MBT) succinate esters are made by reacting mercaptobenzothiazole (MBT) with a malonate or itaconate ester to form the Michael addition product. The maleate and itaconate esters may be reacted with MBT neat without a solvent or with a solvent such as an alcohol, ether, aromatic or alkyl aromatic. The MBT salt may be reacted with the malonate or itaconate esters or as the neutral MBT itself with a basic catalyst. Catalyzed reactions may use basic catalysts such as tertiary amines N,N-dimethylaminopyridine (DMAP) and 1,8-diazabicyclo[5.4.0]undec-7-ene (DBU) or triethylene diamine (DABCO). The reactions are carried out under an inert atmosphere such as nitrogen at temperatures of 60 to 160° C. At the end of the Michael reaction, the solvent (if used) is stripped off under vacuum and the crude reaction material is dissolved in toluene or xylenes. This solution is washed with aqueous base or caustic to remove unreacted MBT then washed several times with water. The solvent is then stripped away under vacuum to yield the final product.

Synthesis of Dibutyl 2-(S(N)-mercaptobenzothiazole methylene) Succinate

In a 100 mL reaction flask, under a nitrogen atmosphere, is charged 24.2 grams of dibutyl itaconate and 1.2 grams of DMAP. The reaction mixture is heated with stirring to 110° C. under a nitrogen atmosphere. MBT (18.4 grams) is slowly added over 15 minutes maintaining the temperature between 108-110° C. The reaction was continued for an additional one hour, then cooled to room temperature and diluted with 50 mL of xylenes. This solution was then washed once with 10 mL of a 10 wt % aqueous solution of sodium hydroxide to remove unreacted MBT. The organic reaction solution was then washed twice with 50 mL of 70° C. water. The reaction product solution was then stripped of the xylenes solvent under vacuum to yield an amber colored liquid.

Synthesis of Dibutyl 2-(S(N)-mercaptobenzothiazole) Succinate

In a 100 mL reaction flask, under a nitrogen atmosphere, is charged 22.8 grams of dibutyl maleate and 1.2 grams of DMAP. The reaction mixture is heated with stirring to 110° C. under a nitrogen atmosphere. MBT (18.4 grams) is slowly added over 15 minutes maintaining the temperature between 108-110° C. The reaction was continued for an additional one hour then cooled to room temperature and diluted with 50 mL of xylenes. This solution was then washed once with 10 mL of a 10 wt % aqueous solution of sodium hydroxide to remove unreacted MBT. The organic reaction solution was then washed twice with 50 mL of 70° C. water. The reaction product solution was then stripped of the xylenes solvent under vacuum to yield a yellow colored liquid.

The additives of the present invention are useful alone or in combination with zinc dihydrocarbyldithiophosphate, which is an improvement over the prior art. They can also be used in combination with other additives typically found in lubricating oils, as well as with other anti-wear additives. The additives typically found in lubricating oils are, for example, dispersants, detergents, corrosion/rust inhibitors, antioxidants, anti-wear agents, anti-foamants, friction modifiers, seal swell agents, demulsifiers, viscosity index (V.I.) improvers, pour point depressants, and the like. See, for example, U.S. Pat. No. 5,498,809 for a description of useful lubricating oil composition additives, the disclosure of which is incorporated herein by reference in its entirety.

As noted above, suitable anti-wear compositions may include dihydrocarbyldithiophosphates. Preferably, the hydrocarbyl groups contain an average of at least three carbon atoms. Particularly useful are metal salts of at least one dihydrocarbyl dithiophosphoric acid wherein the hydrocarbyl groups contain an average of at least three carbon atoms. The acids from which the dihydrocarbyl dithiophosphates are preferably derived can be illustrated by acids of the formula:

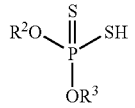

wherein $R^2$ and $R^3$ are the same or different and are alkyl, cycloalkyl, aralkyl, alkaryl, or substituted substantially hydrocarbon radical derivatives of any of the above groups, and wherein the $R^2$ and $R^3$ groups in the acid each have, on average, at least three carbon atoms. By "substantially hydrocarbon" is meant radicals containing atoms or groups, e.g., 1 to 4 substituent groups per radical moiety, such as ether, ester, nitro, halogen, or the like, that do not materially affect the hydrocarbon character of the radical.

Specific examples of suitable $R^2$ and $R^3$ radicals include isopropyl, isobutyl, n-butyl, sec-butyl, n-hexyl, heptyl, 2-ethylhexyl, diisobutyl, isooctyl, decyl, dodecyl, tetradecyl, hexadecyl, octadecyl, butylphenyl, o,p-dipentylphenyl, octylphenyl, polyisobutene-(molecular weight about 350)-substituted phenyl, tetrapropylene-substituted phenyl, β-octylbutylnaphthyl, cyclopentyl, cyclohexyl, phenyl, chlorophenyl, o-dichlorophenyl, bromophenyl, naphthenyl, 2-methylcyclohexyl, benzyl, chlorobenzyl, chloropentyl, dichlorophenyl, nitrophenyl, dichlorodecyl, xenyl, and similar radicals. Alkyl radicals having from about 3 to about 30 carbon atoms and aryl radicals having from about 6 to about 30 carbon atoms are preferred. Particularly preferred $R^2$ and $R^3$ radicals are alkyl of from 3 to 12 carbon atoms.

The phosphorodithioic acids are readily obtainable by the reaction of phosphorus pentasulfide and an alcohol or phenol. The reaction involves mixing, at a temperature of about 20° C. to about 200° C., four moles of the alcohol or phenol with one mole of phosphorus pentasulfide. Hydrogen sulfide is liberated as the reaction takes place. Mixtures of alcohols, phenols, or both can be employed, e.g., mixtures of $C_3$ to $C_{30}$ alcohols, $C_6$ to $C_{30}$ aromatic alcohols, and the like.

The metals useful to make the phosphate salts include Group I metals, Group II metals, aluminum, lead, tin, molybdenum, manganese, cobalt, and nickel. Zinc is the preferred metal. Examples of metal compounds that can be reacted with the acid include lithium oxide, lithium hydroxide, lithium carbonate, lithium pentylate, sodium oxide, sodium hydroxide, sodium carbonate, sodium methylate, sodium propylate, sodium phenoxide, potassium oxide, potassium hydroxide, potassium carbonate, potassium methylate, silver oxide, silver carbonate, magnesium oxide, magnesium hydroxide, magnesium carbonate, magnesium ethylate, magnesium propylate, magnesium phenoxide, calcium oxide, calcium hydroxide, calcium carbonate, calcium methylate, calcium propylate, calcium pentylate, zinc oxide, zinc hydroxide, zinc carbonate, zinc propylate, strontium oxide, strontium hydroxide, cadmium oxide, cadmium hydroxide, cadmium carbonate, cadmium ethylate, barium oxide, barium hydroxide, barium hydrate, barium carbonate, barium ethylate, barium pentylate, aluminum oxide, aluminum propylate, lead oxide, lead hydroxide, lead carbonate, tin oxide, tin butylate, cobalt oxide, cobalt hydroxide, cobalt carbonate, cobalt pentylate, nickel oxide, nickel hydroxide, nickel carbonate, and the like.

In some instances, the incorporation of certain ingredients, particularly carboxylic acids or metal carboxylates, such as, small amounts of the metal acetate or acetic acid, used in conjunction with the metal reactant will facilitate the reaction and result in an improved product. For example, the use of up to about 5% of zinc acetate in combination with the required amount of zinc oxide facilitates the formation of a zinc phosphorodithioate.

The preparation of metal phosphorodithioates is well known in the art and is described in a large number of issued patents, including U.S. Pat. Nos. 3,293,181; 3,397,145; 3,396,109; and 3,442,804; the disclosures of which are hereby incorporated by reference. Also useful as anti-wear additives are amine derivatives of dithiophosphoric acid compounds, such as are described in U.S. Pat. No. 3,637,499, the disclosure of which is hereby incorporated by reference in its entirety.

The zinc salts are most commonly used as anti-wear additives in lubricating oil in amounts of 0.1 to 10, preferably 0.2 to 2, wt. %, based upon the total weight of the lubricating oil composition. They may be prepared in accordance with known techniques by first forming a dithiophosphoric acid, usually by reaction of an alcohol or a phenol with $P_2S_5$ and then neutralizing the dithiophosphoric acid with a suitable zinc compound.

Mixtures of alcohols can be used, including mixtures of primary and secondary alcohols, secondary generally for imparting improved anti-wear properties and primary for thermal stability. In general, any basic or neutral zinc compound could be used, but the oxides, hydroxides, and carbonates are most generally employed. Commercial additives frequently contain an excess of zinc owing to use of an excess of the basic zinc compound in the neutralization reaction.

The zinc dihydrocarbyl dithiophosphates (ZDDP) are oil soluble salts of dihydrocarbyl esters of dithiophosphoric acids and can be represented by the following formula:

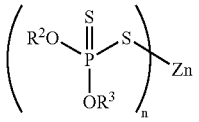

wherein n, $R^2$, and $R^3$ are as described above.

Examples of dispersants include polyisobutylene succinimides, polyisobutylene succinate esters, Mannich Base ashless dispersants, succinimide derivativized olefinic copolymers, such as ethylene-propylene copolymers and terpolymers, and the like. Examples of detergents include metallic and ashless alkyl phenates, metallic and ashless sulfurized alkyl phenates, metallic and ashless alkyl sulfonates, metallic and ashless alkyl salicylates, metallic and ashless saligenin derivatives, and the like.

Examples of antioxidants include alkylated diphenylamines, N-alkylated phenylenediamines, phenyl-α-naphthylamine, alkylated phenyl-α-naphthylamine, dimethyl quinolines, trimethyldihydroquinolines and oligomeric compositions derived therefrom, hindered phenolics, alkylated hydroquinones, hydroxylated thiodiphenyl ethers, alkylidenebisphenols, thiopropionates, metallic dithiocarbamates, 1,3,4-dimercaptothiadiazole and derivatives, oil soluble copper compounds, and the like.

The following are exemplary of such additives and are commercially available from Crompton Corporation: Naugalube® 438, Naugalube 438L, Naugalube 640, Naugalube 635, Naugalube 680, Naugalube AMS, Naugalube APAN, Naugard® PANA, Naugalube TMQ, Naugalube 531, Naugalube 431, Naugard BHT, Naugalube 403, and Naugalube 420, among others.

Examples of additional anti-wear additives that can be used in combination with the additives of the present invention include organo-borates, organo-phosphites, organo-phosphates, organic sulfur-containing compounds, sulfurized olefins, sulfurized fatty acid derivatives (esters), chlorinated paraffins, dialkyldithiophosphate esters, diaryl dithiophosphate esters, phosphosulfurized hydrocarbons, and the like.

The following are exemplary of such additives and are commercially available from The Lubrizol Corporation: Lubrizol 677A, Lubrizol 1095, Lubrizol 1097, Lubrizol 1360, Lubrizol 1395, Lubrizol 5139, and Lubrizol 5604, among others; and from Ciba Corporation: Irgalube 353.

Examples of friction modifiers include fatty acid esters and amides, organo molybdenum compounds, molybdenum dialkyldithiocarbamates, molybdenum dialkyl dithiophosphates, molybdenum disulfide, tri-molybdenum cluster dialkyldithiocarbamates, non-sulfur molybdenum compounds and the like.

The following are exemplary of molybdenum additives and are commercially available from R.T. Vanderbilt Company, Inc.: Molyvan A, Molyvan L, Molyvan 807, Molyvan 856B, Molyvan 822, Molyvan 855, among others. The following are also exemplary of such additives and are commercially available from Asahi Denka Kogyo K.K.: SAKURA-LUBE 100, SAKURA-LUBE 165, SAKURA-LUBE 300, SAKURA-LUBE 310G, SAKURA-LUBE 321, SAKURA-LUBE 474, SAKURA-LUBE 600, SAKURA-LUBE 700, among others. The following are also exemplary of such additives and are commercially available from Akzo Nobel Chemicals GmbH: Ketjen-Ox 77M, Ketjen-Ox 77TS, among others; and from Crompton Corporation: Naugalube® MolyFM 2543.

An example of an anti-foamant is polysiloxane, and the like. Examples of rust inhibitors are polyoxyalkylene polyol, benzotriazole derivatives, and the like. Examples of V.I. improvers include olefin copolymers and dispersant olefin copolymers, and the like. An example of a pour point depressant is polymethacrylate, and the like.

Lubricant Compositions

Compositions, when they contain these additives, are typically blended into a base oil in amounts such that the additives therein are effective to provide their normal attendant functions. Representative effective amounts of such additives are illustrated in TABLE 1.

TABLE 1

| Additives | Preferred Weight % | More Preferred Weight % |
|---|---|---|
| V.I. Improver | 1-12 | 1-4 |
| Corrosion Inhibitor | 0.01-3 | 0.01-1.5 |
| Oxidation Inhibitor | 0.01-5 | 0.01-1.5 |
| Dispersant | 0.1-10 | 0.1-5 |
| Lube Oil Flow Improver | 0.01-2 | 0.01-1.5 |
| Detergent/Rust Inhibitor | 0.01-6 | 0.01-3 |
| Pour Point Depressant | 0.01-1.5 | 0.01-0.5 |
| Anti-foaming Agents | 0.001-0.1 | 0.001-0.01 |
| Anti-wear Agents | 0.001-5 | 0.001-1.5 |
| Seal Swell Agents | 0.1-8 | 0.1-4 |
| Friction Modifiers | 0.01-3 | 0.01-1.5 |
| Lubricating Base Oil | Balance | Balance |

When other additives are employed, it may be desirable, although not necessary, to prepare additive concentrates comprising concentrated solutions or dispersions of the subject additives of this invention (in concentrate amounts herein-above described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil can be facilitated by solvents and by mixing accompanied by mild heating, but this is not essential. The concentrate or additive-package will typically be formulated to contain the additives in proper amounts to provide the desired concentration in the final formulation when the additive-package is combined with a predetermined amount of base lubricant. Thus, the subject additives of the present invention can be added to small amounts of base oil or other compatible solvents along with other desirable additives to form additive-packages containing active ingredients in collective amounts of, typically, from about 2.5 to about 90 percent, preferably from about 15 to about 75 percent, and more preferably from about 25 percent to about 60 percent by weight additives in the appropriate proportions with the remainder being base oil. The final formulations can typically employ about 1 to 20 weight percent of the additive-package with the remainder being base oil.

All of the weight percentages expressed herein (unless otherwise indicated) are based on the active ingredient (AI) content of the additive, and/or upon the total weight of any additive-package, or formulation, which will be the sum of the AI weight of each additive plus the weight of total oil or diluent.

In general, the lubricant compositions of the invention contain the additives in a concentration ranging from about 0.05 to about 30 weight percent. A concentration range for the additives ranging from about 0.1 to about 10 weight percent based on the total weight of the oil composition is preferred. A more preferred concentration range is from about 0.2 to about 5 weight percent. Oil concentrates of the additives can contain from about 1 to about 75 weight percent of the additive reaction product in a carrier or diluent oil of lubricating oil viscosity.

In general, the additives of the present invention are useful in a variety of lubricating oil base stocks. The lubricating oil base stock is any natural or synthetic lubricating oil base stock fraction having a kinematic viscosity at 100° C. of about 2 to about 200 cSt, more preferably about 3 to about 150 cSt, and most preferably about 3 to about 100 cSt. The lubricating oil base stock can be derived from natural lubricating oils, synthetic lubricating oils, or mixtures thereof. Suitable lubricating oil base stocks include base stocks obtained by isomerization of synthetic wax and wax, as well as hydrocracked base stocks produced by hydrocracking (rather than solvent extracting) the aromatic and polar components of the crude. Natural lubricating oils include animal oils, such as lard oil, vegetable oils (e.g., canola oils, castor oils, sunflower oils), petroleum oils, mineral oils, and oils derived from coal or shale.

Synthetic oils include hydrocarbon oils and halo-substituted hydrocarbon oils, such as polymerized and interpolymerized olefins, gas-to-liquids prepared by Fischer-Tropsch technology, alkylbenzenes, polyphenyls, alkylated diphenyl ethers, alkylated diphenyl sulfides, as well as their derivatives, analogs, homologs, and the like. Synthetic lubricating oils also include alkylene oxide polymers, interpolymers, copolymers, and derivatives thereof, wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers. Other esters useful as synthetic oils include those made from copolymers of α-olefins and dicarboxylic acids which are esterified with short or medium chain length alcohols.

The following are exemplary of such additives and are commercially available from Akzo Nobel Chemicals SpA: Ketjenlubes 115, 135, 165, 1300, 2300, 2700, 305, 445, 502, 522, and 6300, among others.

Silicon-based oils, such as the polyalkyl-, polyaryl-, polyalkoxy-, or polyaryloxy-siloxane oils and silicate oils, comprise another useful class of synthetic lubricating oils. Other synthetic lubricating oils include liquid esters of phosphorus-containing acids, polymeric tetrahydrofurans, poly α-olefins, and the like.

The lubricating oil may be derived from unrefined, refined, re-refined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Re-refined oils are obtained by treating refined oils in processes similar to those used to obtain the refined oils. These re-refined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the waxes produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a V.I. of at least 130, preferably at least 135 or higher and, following dewaxing, a pour point of about −20° C. or lower.

The additives of the present invention are especially useful as components in many different lubricating oil compositions. The additives can be included in a variety of oils with lubricating viscosity, including natural and synthetic lubricating oils and mixtures thereof. The additives can be included in crankcase lubricating oils for spark-ignited and compression-ignited internal combustion engines. The compositions can also be used in gas engine lubricants, turbine lubricants, automatic transmission fluids, gear lubricants, compressor lubricants, metal-working lubricants, hydraulic fluids, and other lubricating oil and grease compositions. The additives can also be used in motor fuel compositions.

The advantages and the important features of the present invention will be more apparent from the following examples.

EXAMPLES

Anti-Wear Four-Ball Testing

The samples of the present invention were blended at 1.0 wt % in a fully formulated SAE 5W-20 Prototype GF-3 Motor Oil formulation and their anti-wear properties were determined in the Four-Ball Wear Test under the ASTM D 4172 test conditions. The fully formulated lubricating oils tested also contained 1 wt % cumene hydroperoxide to help simulate the environment within a running engine. The testing for these examples was done on a Falex Variable Drive Four-Ball Wear Test Machine. Four balls are arranged in an equilateral tetrahedron. The lower three balls are clamped securely in a test cup filled with lubricant and the upper ball is held by a chuck that is motor-driven. The upper ball rotates against the fixed lower balls. Load is applied in an upward direction through a weight/lever arm system. Loading is through a continuously variable pneumatic loading system. Heaters allow operation at elevated oil temperatures. The three stationary steel balls are immersed in 10 milliliters of sample to be tested, and the fourth steel ball is rotated on top of the three stationary balls in "point-to-point contact." The machine is operated for one hour at 75° C. with a load of 40 kilograms and a rotational speed of 1,200 revolutions per minute. The additives were tested for effectiveness in a motor oil formulation (See Table 1) and compared to identical formulations with and without any zinc dialkyldithiophosphate. In Table 2, the numerical value of the test results (Average Wear Scar Diameter, mm) decreases with an increase in effectiveness.

D 2783 Standard Test Method for Measurement of Extreme-Pressure Properties of Lubricating Fluids (Four-Ball Method)

This test method covers the determination of the load carrying properties of lubricating fluids. The following two determinations are made: Load-wear index (formerly Mean-Hertz load) and Weld point by means of the four-ball extreme-pressure (EP) tester. The values stated in either inch-pound units or SI (metric) units are to be regarded separately as standard.

The load-wear index (or the load-carrying property of a lubricant) is an index of the ability of a lubricant to minimize wear at applied loads. Under the conditions of this test, specific loadings in kilograms-force (or newtons) having intervals of approximately 0.1 logarithmic units, are applied to the three stationary balls for ten runs prior to welding. The load-wear is determined for the ten applied loads immediately preceding the weld point.

The weld point, under the conditions of this test, is the lowest applied load in kilograms at which the rotating ball welds to the three stationary balls, indicating the extreme pressure level of the lubricants-force (or newtons) has been exceeded.

Additive Performance—The higher the recorded Weld point and Load-Wear Index values of the reference test oil plus added test additive relative to the reference oil itself, the better is the performance of the test additive.

Summary of Test Method

The samples of the present invention were blended at 1.0 wt % active ingredient in a fully formulated SAE 5W-20 prototype GF-4 motor oil formulation to determined their anti-wear properties in this Four-Ball Test under the ASTM D 2783 test conditions. The tester is operated with one steel ball under load rotating against three steel balls held stationary in the form of a cradle. The above blended test lubricant oil is added to cover the lower three balls. The rotating speed is 1760@ 40 rpm. The machine and test lubricant are brought to 18.33 to 35.0° C. (65 to 95° F.) and then a series of tests of 10-s duration are made at increasing loads until welding occurs. Ten tests are made below the welding point. If ten loads have not been run when welding occurs and the scars at loads below seizure are within 5% of the compensation line (See ASTM D2783 procedure document, AB FIG. 1), no further runs are necessary. The total can be brought to ten by assuming that loads below the last non-seizure load will produce wear scars equal to the "compensation scar diameter." Values of these "assumed" scars are given in the ASTM D2783 procedure document in that document's Table 1. For a more detailed description of this test, review the actual published ASTM D 2783-88 procedure document.

TABLE 2

Four-Ball Wear Results

| Compound (at 1.0 wt %) (Lower values are associated with better performance) | Wear Scar Diameter, mm (repeat run) |
|---|---|
| Dibutyl 2-(S(N)-mercaptobenzothiazole) succinate | 0.47(0.53, 0.62) |
| Di(2-ethylhexyl) 2-(S(N)-mercaptobenzothiazole) succinate | 0.61(0.64) |
| Dibutyl 2-(S(N)-mercaptobenzothiazole methylene) succinate | 0.67(0.67) |
| No anti-wear additive* | 0.80(0.71) |
| Zinc dialkyldithiophosphate (1.0 wt %) | 0.44(0.45) |
| Zinc dialkyldithiophosphate (0.5 wt %) | 0.48(0.48) |

TABLE 3

Four-Ball Extreme Pressure Wear Results (ASTM D2783)

| (Higher values associated with better performance) Compound (at 1.3 wt %) | Weld Point. kg | Load-Wear Index, kg |
|---|---|---|
| Dibutyl 2-(S(N)-mercaptobenzothiazole) succinate | 126 | 31.9 |
| Di(2-ethylhexyl) 2-(S(N)-mercaptobenzothiazole) succinate | — | — |
| Dibutyl 2-(S(N)-mercaptobenzothiazole methylene) succinate | 126 | 31.9 |
| No anti-wear additive* | 100 | 13.6 |

*In the case of No anti-wear additive in Tables 2 and 3, solvent neutral 100 is put in its place at 1.0 weight percent.

Anti-Wear Cameron-Plint TE77 High Frequency Friction Machine Testing

The anti-wear properties of the additives of this invention in a fully formulated lubricating oil were determined in the Cameron-Plint TE77 High Frequency Friction Machine Test. The specimen parts (6 mm diameter AISI 52100 steel ball of 800±20 kg/mm$^2$ hardness and hardened ground NSOH B01 gauge plate of RC 60/0.4 micron) were rinsed and then sonicated for 15 minutes with technical grade hexanes. This procedure was repeated with isopropyl alcohol. The specimens were dried with nitrogen and set into the TE77. The oil bath was filled with 10 mL of sample. The test was run at a 30 Hertz Frequency, 100 Newton Load, 2.35 mm amplitude. The test starts with the specimens and oil at room temperature. Immediately, the temperature was ramped over 15 minutes to 50° C., where it dwelled for 15 minutes. The temperature was then ramped over 15 minutes to 100° C., where it dwelled for 45 minutes. A third temperature ramp over 15 minutes to 150° C.

was followed by a final dwell at 150° C. for 15 minutes. The total length of the test was two hours. At the end of the test, the wear scar diameter on the 6 mm ball was measured using a Leica StereoZoom6® Stereomicroscope and a Mitutoyo 164 series Digimatic Head. The fully formulated lubricating oils tested contained 1 wt. % cumene hydroperoxide to help simulate the environment within a running engine. The additives were tested for effectiveness in motor oil formulations and compared to identical formulations with and without any zinc dialkyldithiophosphate. In Table 4, the numerical value of the test results (Ball Wear Scar Diameter, Plate Scar Width, and Plate Scar Depth) decreases with an increase in effectiveness.

TABLE 4

Cameron Flint Wear Test

| Additive at 1.0 wt % | Ball Scar (mm) | Plate Scar Width (mm) | Plate Scar Depth (μm) |
|---|---|---|---|
| Dibutyl 2-mercaptobenzothiazole succinate | 0.68 | 0.18 | 2.06 |
| Dibutyl 2-(S(N)-mercaptobenzothiazole methylene) succinate | 0.73 | 0.43 | 1.85 |
| No anti-wear additive* | 0.66 | 0.74 | 15.05 |
| Zinc dialkyldithiophosphate (1.0 wt %) | 0.39 | 0.72 | 1.83 |
| Zinc dialkyldithiophosphate (0.5 wt %) | 0.62 | 0.76 | 14.77 |

*In the case of No anti-wear additive in Table 4, solvent neutral 100 is put in its place at 1.0 weight percent.

In view of the many changes and modifications that can be made without departing from principles underlying the invention, reference should be made to the appended claims for an understanding of the scope of the protection to be afforded the invention.

What is claimed is:

1. A composition comprising:

(A) a lubricant or a hydrocarbon fuel;

(B) at least one additive of a structure selected from the group consisting of:

(N)

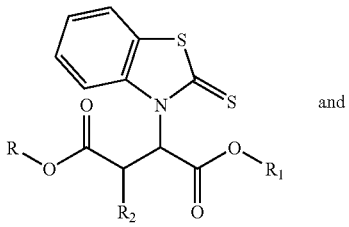

and (N)

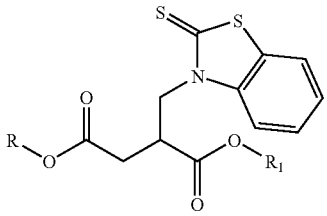

and wherein R, $R_1$ and $R_2$ are independently selected from the group consisting of linear and branched alkyl groups; and, optionally, (C) at least one zinc dihydrocarbyldithiophosphate of formula:

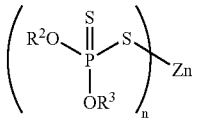

wherein n is 2, and $R^2$ and $R^3$ are independently selected hydrocarbyl groups or hydrocarbyl-substituted alkyl groups.

2. The composition of claim 1 wherein (A) is a lubricating oil.

3. The composition of claim 1 wherein R, $R_1$ and $R_2$ of the at least one additive are independently selected from the group consisting of linear and branched alkyl groups of from 1 to about 12 carbon atoms.

4. The composition of claim 2 wherein R, $R_1$ and $R_2$ of the at least one additive are independently selected from the group consisting of linear and branched alkyl groups of from 1 to about 12 carbon atoms.

5. The composition of claim 1 wherein $R^2$ and $R^3$ of the at least one zinc dihydrocarbyldithiophosphate are independently selected alkyl, cycloalkyl, aralkyl, alkaryl, or hydrocarbyl-substituted alkyl, cycloalkyl, aralkyl, or alkaryl groups, and wherein the $R^2$ and $R^3$ groups in the acid each have, on average, at least three carbon atoms.

6. The composition of claim 2 wherein $R^2$ and $R^3$ of the at least one zinc dihydrocarbyldithiophosphate are independently selected alkyl, cycloalkyl, aralkyl, alkaryl, or hydrocarbyl-substituted alkyl, cycloalkyl, aralkyl, or alkaryl groups, and wherein the $R^2$ and $R^3$ groups in the acid each have, on average, at least three carbon atoms.

7. The composition of claim 1 wherein (C) is present.

8. A method for improving the anti-fatigue, anti-wear, and extreme pressure properties of lubricants and hydrocarbon fuels comprising adding to said lubricants and hydrocarbon fuels:

(A) at least one additive of a structure selected from the group consisting of:

(N)

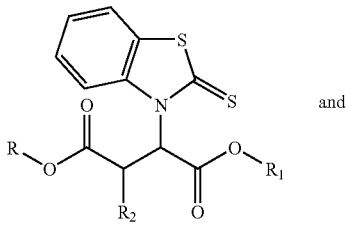

and (N)

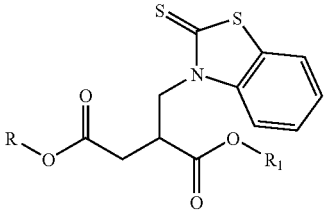

and wherein R, $R_1$ and $R_2$ are independently selected from the group consisting of linear and branched alkyl groups; and, optionally, (B) at least one zinc dihydrocarbyldithiophosphate of formula:

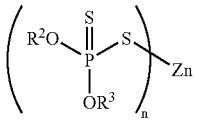

wherein n is 2, and $R^2$ and $R^3$ are independently selected hydrocarbyl groups or hydrocarbyl-substituted alkyl groups.

9. The method of claim 8 wherein the lubricant is a lubricating oil.

10. The method of claim 8 wherein R, $R_1$ and $R_2$ of the at least one additive are independently selected from the group consisting of linear and branched alkyl groups of from 1 to about 12 carbon atoms.

11. The method of claim 9 wherein R, $R_1$ and $R_2$ of the at least one additive are independently selected from the group consisting of linear and branched alkyl groups of from 1 to about 12 carbon atoms.

12. The method of claim 8 wherein R, $R_1$ and $R_2$ of the at least one additive are independently selected alkyl, cycloalkyl, aralkyl, alkaryl, or hydrocarbyl-substituted alkyl, cycloalkyl, aralkyl, or alkaryl groups, and wherein the $R^2$ and $R^3$ groups in the acid each have, on average, at least three carbon atoms.

13. The method of claim 9 wherein $R^2$ and $R^3$ of the at least one zinc dihydrocarbyldithiophosphate are independently selected alkyl, cycloalkyl, aralkyl, alkaryl, or hydrocarbyl-substituted alkyl, cycloalkyl, aralkyl, or alkaryl groups, and wherein the $R^2$ and $R^3$ groups in the acid each have, on average, at least three carbon atoms.

14. The method of claim 8 wherein (B) is present.

15. A method for improving the anti-fatigue, anti-wear, and extreme pressure properties of a lubricating oil comprising adding to said oil:

(A) from about 0.01 to about 10 wt % of at least one additive of a structure selected from the group consisting of:

(N)

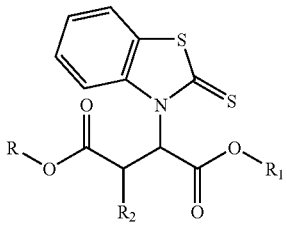

and

-continued (N)

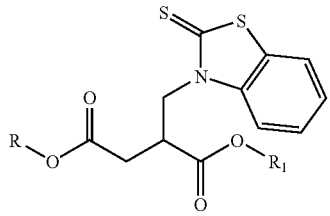

and wherein R, $R_1$ and $R_2$ are independently selected from the group consisting of linear and branched alkyl groups of from 1 to about 12 carbon atoms; and, optionally, (B) from about 0.01 to about 10 wt % of at least one zinc dihydrocarbyldithiophosphate of formula:

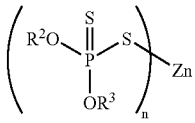

wherein n is 2, and $R^2$ and $R^3$ are independently selected alkyl, cycloalkyl, aralkyl, alkaryl, or hydrocarbyl-substituted alkyl, cycloalkyl, aralkyl, or alkaryl groups, and wherein the $R^2$ and $R^3$ groups in the acid each have, on average, at least three carbon atoms.

16. The composition of claim 1 wherein (B) is present in a concentration in the range of from about 0.01 to about 10 wt %.

17. The composition of claim 1 wherein (C) is present in a concentration in the range of from about 0.01 to about 10 wt %.

18. The method of claim 8 wherein (A) is present in a concentration in the range of from about 0.01 to about 10 wt %.

19. The method of claim 8 wherein (B) is present in a concentration in the range of from about 0.01 to about 10 wt %.

* * * * *